United States Patent [19]

Skeggs

[11] 4,055,839

[45] Oct. 25, 1977

[54] FOALING ALARM

[75] Inventor: Leonard T. Skeggs, Kirtland, Ohio

[73] Assignee: Locust Farms, Inc., Kirtland, Ohio

[21] Appl. No.: 698,948

[22] Filed: June 23, 1976

Related U.S. Application Data

[63] Continuation-in-part of Ser. No. 598,749, July 25, 1975, abandoned.

[51] Int. Cl.[2] ..... G08B 21/00

[52] U.S. Cl. ..... 340/279; 119/1; 128/361; 340/224; 340/282

[58] Field of Search ..... 340/279, 224, 282; 128/2.1 A, 2 S, 361; 119/1; 200/DIG. 2

[56] References Cited

U.S. PATENT DOCUMENTS

| | | | |
|---|---|---|---|
| 3,268,845 | 8/1966 | Whitmore | 128/2 S |
| 3,533,095 | 10/1970 | Collins | 128/2 S |
| 3,572,316 | 3/1971 | Vogelman et al. | 128/2.1 A |
| 3,588,858 | 6/1971 | Demuth | 340/224 |
| 3,740,648 | 6/1973 | Grotjahn | 340/224 |
| 3,827,403 | 8/1974 | Meyer | 119/29 |

*Primary Examiner*—Glen R. Swann, III

*Attorney, Agent, or Firm*—Donnelly, Maky, Renner & Otto

[57] ABSTRACT

A foaling alarm adapted to be positioned around the withers and belly of a mare just behind the forearms and having, in the region of the withers, an RF transmitter, and a position sensing switch which energizes the transmitter when the mare lies down on her side in foaling position. The transmitter, when thus energized, actuates a remote receiver which, in turn, actuates an audio and/or visual alarm for summoning aid by the mare's attendant or owner.

21 Claims, 8 Drawing Figures

FOALING ALARM

RELATED U.S. APPLICATION DATA

This is a continuation-in-part of Ser. No. 598,749, filed July 25, 1975, abandoned.

BACKGROUND OF THE INVENTION

Those who are involved in the breeding, propagation and production of horses generally agree that it is wise and the best practice for someone to be in attendance when a mare gives birth to her foal. Although a mare may give birth without assistance, it occasionally happens that assistance will be quite helpful. Sometimes there may be more serious problems where an attendant can acutally save the life of the mare or the foal by being present during the delivery of the foal. As is well known, a foal may die simply because the sack did not break and this is a very simple operation if someone is present at the time to break the sack.

Unfortunately, it is not possible to predict precisely when a mare will foal and, although certain signs can be watched for, it often happens that someone must simply observe the mare continuously for hours or days at a time.

In delivering her foal, a mare will lie completely over on her side with her legs stretched out horizontally.

SUMMARY OF THE INVENTION

The foaling alarm herein comprises a detachable device which a few days before the anticipated foaling time is secured over the withers and around the sides and under the forepart of the belly behind the front legs, said device having position sensing means to detect when the mare is in foaling position as aforesaid, said position sensing means being operative to energize a transmitter means to transmit a signal for receipt by a receiver means which, in turn, sets off an alarm system so that the mare owner or attendant is immediately made aware that the mare is about to deliver her foal.

It is a principal object of this invention to provide a foaling alarm as aforesaid in which the upper portion of the device embraces the withers to prevent circumferential slipping of the device around the mare's body so that the position sensing means will be in a predetermined location to sense when the mare lies down in foaling position on either side with her legs stretched out horizontally.

It is another object of this invention to provide a foaling alarm which, when secured on the mare's body as aforesaid, does not interfere with normal activities of the mare such as walking, eating, and sleeping.

Other objects and advantages will appear in the ensuing description.

DETAILED DESCRIPTION OF THE PREFERRED EMBODIMENTS

Figure 1:
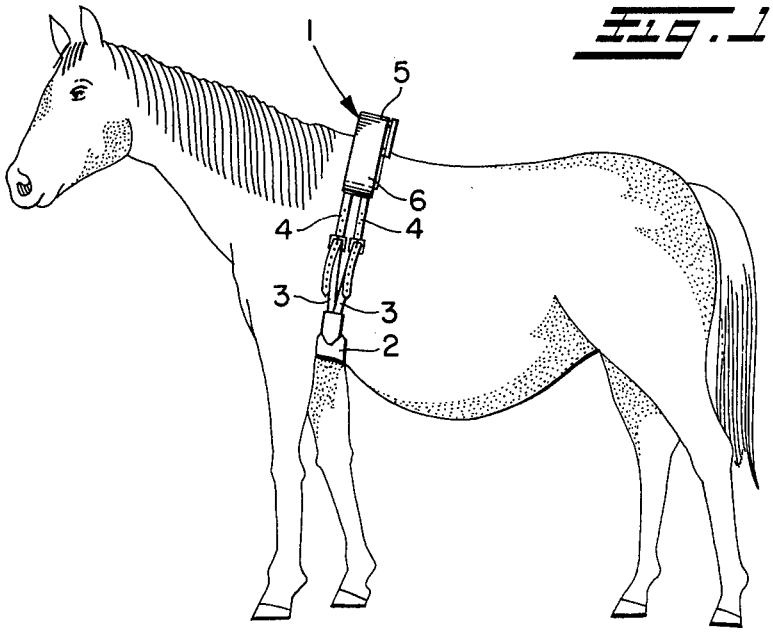
FIG. 1 is a side elevation view of a foaling alarm secured on a mare around the withers and forepart of the belly behind the front legs.
Figure 2:
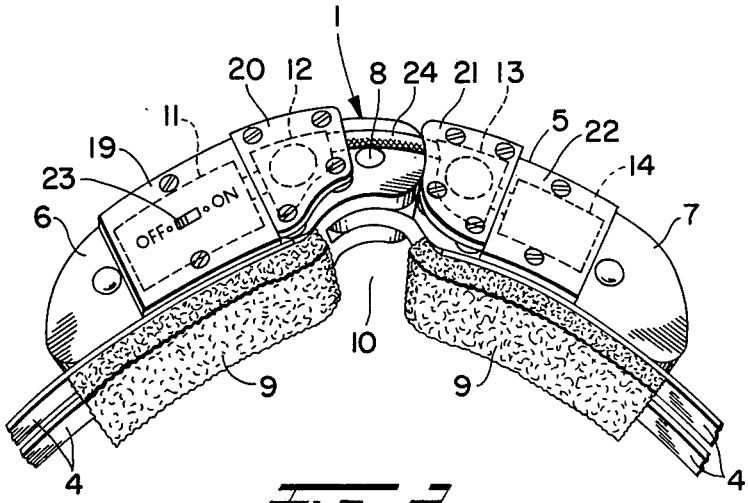
FIG. 2 is a perspective view on enlarged scale of the upper portion of the foaling alarm as viewed upwardly from the rear of FIG. 1.
Figure 3:
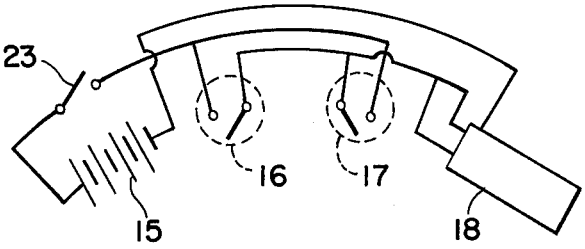
FIG. 3 is a schematic wiring diagram of the foaling alarm.

As best shown in FIGS. 1, 2 and 3, the foaling alarm device 1 has a relatively wide and padded girth portion 2 under the forepart of the belly of the mare just behind the front legs with elastic straps 3 adjustably buckled to leather straps 4 which are secured to the upper portion 5 of the device 1. The upper portion 5 may be made of wood, such as hard maple, or of suitable thermoplastic material and comprises arcuate sections 6 and 7 which are hinged together by the pin 8 and which are provided with relatively thick sponge-like pads 9 for comfort and which define therebetween a recess 10 embracing the withers of the mare thus to retain the alarm 1 against circumferential slipping from the position shown in FIG. 1.

The upper portion 5 of the alarm 1 has recesses or pockets 11, 12, 13 and 14 therein in which are secured respectively an electric power source such as batteries 15, a first position sensing switch 16, a second position sensing switch 17, and an RF transmitter 18, said recesses being closed as by removable cover plates 19, 20, 21 and 22. The cover plate 19 for the battery recess 11 may be provided with a manual switch 23 which, when in "OFF" position, will conserve the batteries 15 when the alarm 1 is not in use regardless of the stored position thereof. The position sensing switches 16 and 17 preferably comprise mercury switches which are normaly open and which are arranged so that one or the other of them will close the electric circuit to the transmitter 18 when the mare lies down on either side in foaling position. Each mercury switch 16 and 17 herein arranged to close its contacts upon 35 to 40° tilting from vertical as the mare goes down to foaling position. Extending across the sections 6 and 7 is a flexible conduit 24 around the conductors which operatively interconnect the batteries 15, switches 23, 16 and 17, and transmitter 18.

By way of example, the transmitter 18 is preferably transistorized of well known form such as Ace Wee 1 Single Channel Tone Transmitter (Ace Radio Control, Higgensville, Missouri 64037) which, when the switch 23 is closed and when either of the mercury switches 16 or 17 is closed will emit a signal of predetermined frequency.

Figure 4:
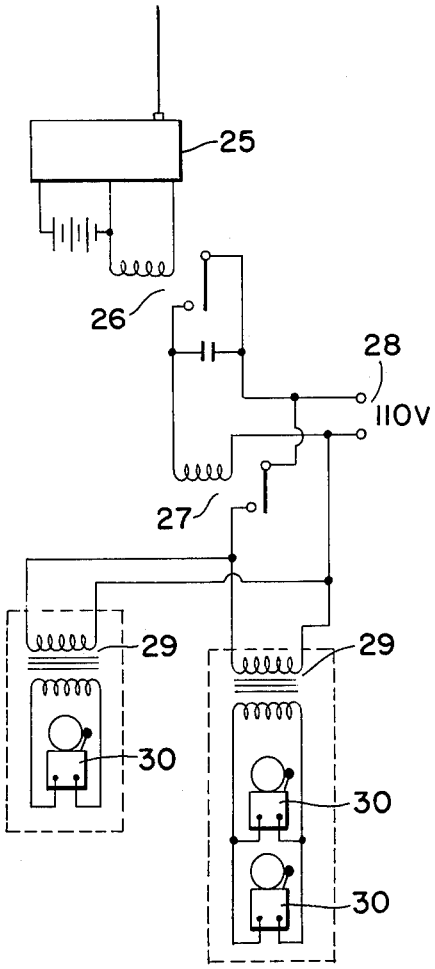
FIG. 4 is a shematic diagram of the receiver and alarm ciruitry.

Referring to FIG. 4, there will be provided in the stable preferably outside the mare's stall, a receiver 25 which is tuned to the frequency of the signal emitted by the transmitter 18 and which preferably is transistorized and energized as by a 3 volt dry cell or other source of electric power. When the receiver 25 receives a signal from the transmitter 18, it will actuate a relay 26 to close an alarm relay 27 and when the contacts of the last-mentioned relay 27 are closed, a circuit will be established from an electric power source 28 through transformers 29 to energize alarm signal means 30 which for convenience have been illustrated as alarm bells, one of which may be installed in the stable and the others may be installed as in the kitchen and bedroom of the mare's owner.

Referring now to the embodiment of the invention illustrated in FIGS. 5–8, the foaling alarm device 31 is generally similar to that illustrated in FIGS. 1-4 in that it comprises a padded girth portion 32 under the forepart of the belly of the mare just behind the front legs, and a padded upper portion 33 which has a withers embracing recess 34 and downwardly diverging arms 35 which engage the mare's back adjacent the withers, said girth and upper portions 32 and 33 being provided with flexible straps 36 which are adjustably buckled together as shown.

Both the girth and upper portions 32 and 33 are padded with plastic fibrous material as shown sewed or otherwise secured to fabric strips 37 to render the same machine washable and line or tumble dried.

Figure 6:
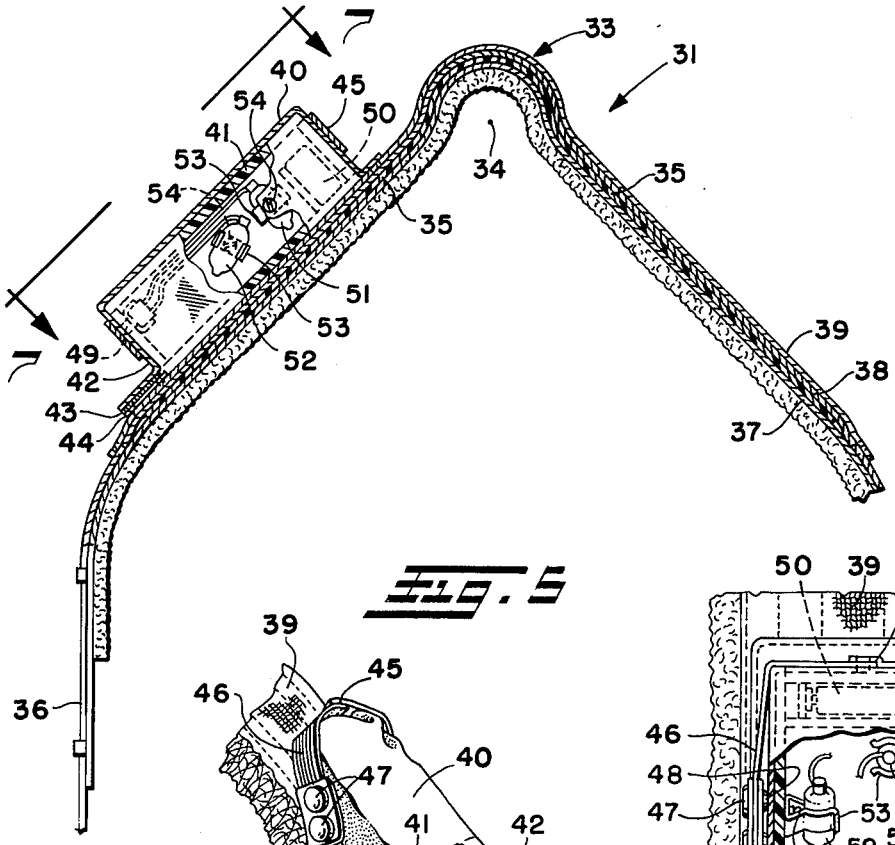
FIG. 6 is a fragmentary enlarged cross-sectional view taken substantially along the line 6—6, FIG. 5.

The upper portion 33 is reenforced by a flexible plastic tree 38 between the fabric strips 37 and 39 so that it will have a normal shape as shown in FIG. 6 but with sufficient flexibility to adjustably fit the mare's back.

Figure 8:
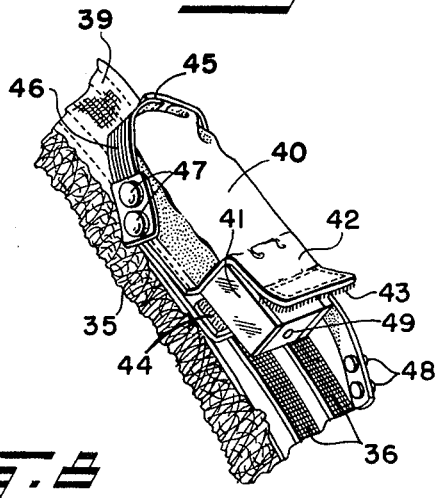
FIG. 8 is a perspective view showing how the transmitter may be readily inserted into or removed from a pocket in the alarm device.
Figure 7:
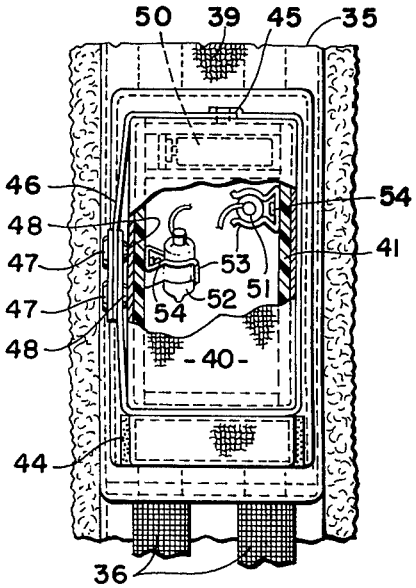
FIG. 7 is a view of the transmitter portion of the foaling alarm as viewed along line 7—7, FIG. 6.

One of the diverging arms 35 has sewed thereto a fabric pocket 40 in which the transmitter and position sensing unit 41 housed within a plastic case is adapted to be positioned as shown in FIG. 6. The pocket 40 is closed by a flap 42 having suitable fastening means such as a Velcro strip 43 cooperating with a Velcro strip 44 sewed to the fabric strip 39. To prevent accidental opening of the flap 42, the pocket 40 has secured thereto a flexible strap 45 including an elastic portion 46 and provided with cooperating snap fasteners 47 and 48. When it is desired to remove unit 41 from pocket 40 the strap 45 is opened and the flap 42 is opened as shown in FIG. 8 whereby the unit 41 may be removed for servicing or replacement or removed for laundering of the upper portion 33 of the device 31. When the unit 41 is inserted into pocket 40 the flap 42 and strap 45 are closed as shown in FIGS. 6 and 7.

The transmitter and position sensing unit 41 is selfcontained and includes an on/off switch 49, a battery 50, the transistorized transmitter circuitry, and the position sensing mercury switches 51 and 52 retained in clips 53 which are secured in desired rotary positions by screws 54.

Figure 5:
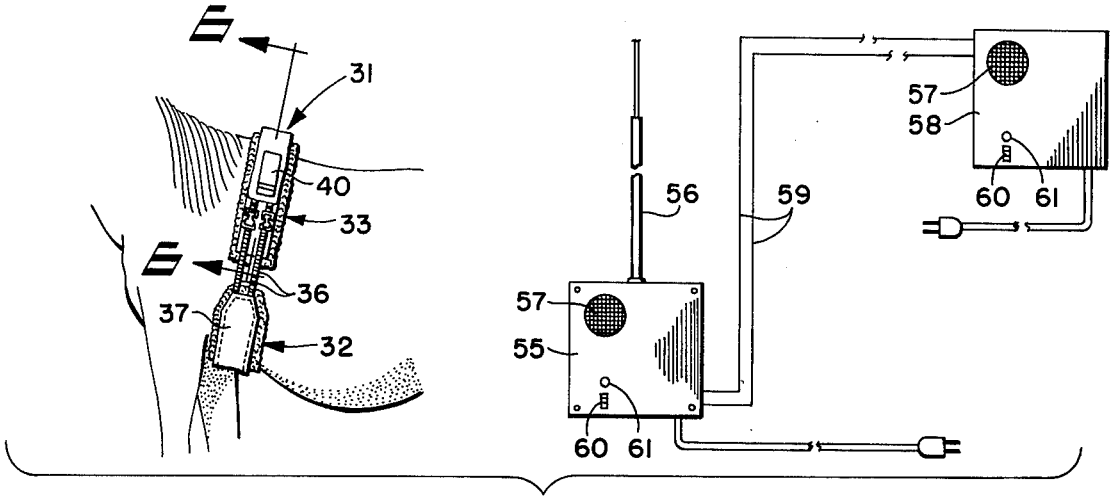
FIG. 5 is a side elevation view of another embodiment of this invention showing in association therewith primary and remote receivers.

When the alarm device 31 is positioned on the mare as shown in FIG. 5, both switches 51 and 52 will be in open position and if the mare lies down to foaling position with the center line of the device 31 extending 30° upwardly from horizontal, either switch 51 or 52 will be closed depending upon whether the mare lays down on her left side or on her right side as viewed in FIG. 6. In this case, the primary receiver 55 has an antenna 56 and when the transmitter and position sensing unit 41 emits a signal of predetermined frequency to which the receiver 55 is tuned, by the closing of one or the other of the mercury switches 51 or 52 the signal received by the primary receiver 55 will close the circuit of the buzzer 57 to signal the mare's owner or attendant that the mare is in foaling position. One or more remote receivers 58 may be connected in parallel by low voltage wiring 59 (e.g. 24v.) with the primary receiver 55 to energize the remote buzzers 57. Each receiver 55 and 58 is adapted to be plugged into a 120 volt supply source and each is equipped with an on/off switch 60 and a pilot light 61 which will be lit when the switch 60 is on.

It is to be understood that, in lieu or in addition to alarm bells 30 or buzzers 57 as herein shown, other forms of alarm signal devices may be employed such as lights or a speaker system. In a more elaborate system, the receiver 25 or 55 may energize a closed circuit TV system to provide both audio and visual signals in the stable and in the owner's home in the kitchen, bedroom and elsewhere therein.

In any case, the person attending the mare may continue with his normal life of eating, working, sleeping, etc. with assurance that he will be warned when the mare is about to foal. Although the position sensing means herein is illustrated as two separate mercury switches 16 and 17 or 51 and 52, it is evident that two sets of contacts may be embodied as in a curved or V-shaped mercury switch with the pool of mercury being disposed normally at the bottom or vertex of the glass enclosure with contacts at the upper ends which are closed according to which side the mare lays down on when foaling. The position sensing switch means 16 and 17 or 51 and 52 obviously may be of the mechanical type which is normally open but which closes the transmitter circuit for emitting and RF signal for actuating the receiver 25 or 55.

Accordingly, it can be seen that the present foaling alarm is of simple construction an economical to manufacture and may be positioned on a mare shortly before the expected time of foaling thereby to provide the owner or attendant a warning signal that the mare is about to deliver her foal. Moreover, the foaling alarm herein is positioned so as not to interfere with normal activities of the mare and does not in any way interfere with the foaling operation. The foaling alarm once positioned on the mare as shown in FIGS. 1 and 5 will be retained by the withers fitting in the recess 10 or 34 between the downwardly diverging arms 6 and 7 or 35; 35 against circumferential displacement and moreover, the sponge-like pads 9 or fibrous pads adjust themselves to comfortably engage the mare's back.

With further reference to the location of the receiver 25 or 55, it is preferably located near the mare's stall but, preferably, outside a wall thereof and, of course, depending on the strength of the signal from the transmitter 18 or 41, the receiver 25 or 55 could be located a considerable distance from the mare's stall.

On rare occasions, an active mare may cause momentary ting-a-lings or buzzings of the alarm means 30 or 57 but this presents no problem because in the foaling position of the mare, the alarm signal is continuous. Although the present ivnention is herein illustrated and described as a foaling alarm, it may be used on a horse who has colic or who it is feared may get colic to provide a signal to the horse owner when the horse is going down to roll thereby to summon aid to prevent death of the horse from a twisted gut.

The embodiments of the invention in which an exclusive property or privilege is claimed are defined as follows:

1. A foaling alarm for signalling the foaling of a mare comprising a device adapted to encircle a mare's body and including an upper portion having a recess to embrace the withers to prevent circumferential displacement of said device, and a flexible girth means connected to said upper portion to engage under the forepart of the belly behind the front legs; transmitter means and position sensing switch means carried by said upper portion; said transmitter means, when energized, being operative to emit a signal of predetermined frequency; said position sensing switch means being operative to energize said transmitter means only when the mare is in foaling position on her side; and remote receiver and alarm signal system means; said receiver means being tuned to said transmitter signal and operative in response thereto to actuate said alarm signal system to provide an alarm signal for summoning aid to facilitate the birth of the foal.

2. The foaling alarm of claim 1 wherein flexible strap and buckle means adjustably interconnect said girth means to said upper portion.

3. The foaling alarm of claim 1 wherein said position sensing means switch means is operative to energize said transmitter means regardless of which side the mare lies down on.

4. The foaling alarm of claim 3 wherein said position sensing switch means comprises mercury switch means.

5. The foaling alarm of claim 1 wherein said upper portion has openable pocket means for insertion or removal of said transmitter means and position sensing switch means.

6. The foaling alarm of claim 1 wherein said transmitter means is battery powered via a circuit which is closed by said position sensing switch means when the mare is in foaling position.

7. The foaling alarm of claim 6 wherein said transmitter means has a manually-operated switch means associated therewith to conserve said battery power during periods of non-use and storage of said device irrespective of the stored position thereof.

8. The foaling alarm of claim 1 wherein said upper portion has downwardly extending strap means to which said girth means is adjustably secured.

9. The foaling alarm of claim 1 wherein said upper portion has downwardly diverging portions to engage the mare's back adjacent the withers; and wherein one of said downwardly diverging portions has pocket means for receiving and retaining therein a unit containing said transmitter means and said position sensing switch means.

10. The foaling alarm of claim 9 wherein said transmitter means is powered by a battery in said unit via an electrical circuit which is closed by said position sensing switch means when the mare is in foaling position.

11. The foaling alarm of claim 10 wherein said unit has a manually operated switch means to conserve said battery during periods or non-use and storage of said device irrespective of the stored position thereof.

12. The foaling alarm of claim 9 wherein said pocket means has a flap which, in conjunction with releasable fastening means, retains said unit in said pocket means or permits insertion and withdrawal of said unit into and from said pocket means.

13. The foaling alarm of claim 9 wherein said position sensing switch means comprises two mercury switches and means for angularly adjusting said switches in said unit so that one or the other of said switches energizes said transmitter means depending on which side the mare lies.

14. The foaling alarm of claim 9 wherein said upper porion, including said pocket means, is of flexible fabric with reinforcement in said recess and downwardly diverging portions and with padding material on the bottom sides of said recess and downwardly diverging portions.

15. The foaling alarm of claim 14 wherein said upper portion has downwardly extending straps for connection with straps of said girth means.

16. The foaling alarm of claim 1 wherein said upper portion comprises hinged together sections which define said recess therebetween.

17. The foaling alarm of claim 16 wherein said sections extend in opposite directions from said recess to engage the mare's back.

18. The alarm system of claim 16 wherein said transmitter means comprises battery means and signal emitting means; and wherein said sections have compartments therein in which said battery means and said signal emitting means are respectively disposed with removable cover plates over said compartments.

19. The foaling alarm of claim 18 wherein flexible conduit means extends across said sections having conductors therein operatively connecting said battery means and position sensing means to said signal emitting means.

20. The foaling alarm of claim 18 wherein one section has manually operated switch means to conserve said battery means during periods of non-use and storage of said device irrespective of the stored position thereof.

21. The foaling alarm of claim 16 wherein each section has flexible strap means extending along the respective opposite sides of the mare's body; and wherein said girth means is adjustably secured to said strap means.

* * * * *